United States Patent [19]

Hess et al.

[11] Patent Number: 4,918,352

[45] Date of Patent: Apr. 17, 1990

[54] METAL HALIDE LAMPS WITH OXIDIZED FRAME PARTS

[75] Inventors: Carl H. Hess, Mentor-on-the-Lake; Frank I. Ewing, Solon; Ralph M. Potter, Pepper Pike; Timothy D. Russell, Huntsburg; Edward G. Zubler, Chagrin Falls, all of Ohio

[73] Assignee: General Electric Company, Schenectady, N.Y.

[21] Appl. No.: 268,144

[22] Filed: Nov. 7, 1988

[51] Int. Cl.[4] ..... H01J 17/18; H01J 61/34

[52] U.S. Cl. ..... 313/25; 313/634; 313/637

[58] Field of Search ..... 313/25, 634, 637; 445/58

[56] References Cited

U.S. PATENT DOCUMENTS

| | | | |
|---|---|---|---|
| 2,951,959 | 9/1960 | Fraser et al. | 313/25 |
| 3,234,421 | 2/1966 | Reiling | 313/25 |
| 3,452,238 | 6/1969 | Larson | 313/229 |
| 3,519,864 | 7/1970 | Gungle et al. | 313/25 |
| 3,569,766 | 3/1971 | Larson | 313/229 |
| 3,737,710 | 6/1973 | Waymouth et al. | 313/174 |
| 3,937,996 | 2/1976 | Cap | 313/217 |
| 3,946,262 | 3/1976 | Keeffe et al. | 313/174 |
| 4,499,396 | 2/1985 | Fohl et al. | 313/25 |
| 4,581,557 | 4/1986 | Johnson | 313/25 |

*Primary Examiner*—Sandra O'Shea

*Attorney, Agent, or Firm*—Edward M. Corcoran; Stanley C. Corwin; Fred Jacob

[57] ABSTRACT

Metal halide lamps having better lumen maintenance over the life of the lamp contain metal frame parts whose surface is oxidized either prior to lamp assembly or oxidized in-situ during operation of the lamp by oxygen or an oxidizing agent present inside the outer vitreous envelope.

2 Claims, 2 Drawing Sheets

METAL HALIDE LAMPS WITH OXIDIZED FRAME PARTS

BACKGROUND OF THE INVENTION

1. Field of the Invention

This invention relates to improved metal halide lamps having oxidized metal frame parts or oxygen in the outer envelope. More particularly, this invention relates to metal halide arc discharge lamps having improved lumen maintenance wherein (i) the surface of the metal frame parts has been oxidized or (ii) the outer jacket contains oxygen or an oxidizing agent, or (iii) a combination thereof.

2. Background of the Disclosure

Metal halide lamps, as is well known to those skilled in the art, contain an electric light source comprising an arc tube made of a vitreous material such as quartz or a high temperature glass which is generally centrally supported within a vitreous outer envelope by metal parts referred to as frame parts. For the most part such frame parts are generally nickel plated steel which is inexpensive, corrosion resistant and which has a clear, shiny appearance that meets with customer acceptance. The outer envelope generally has a stem or neck-shaped portion on at least one end thereof which terminates in a substantially metal base portion. The arc tube or electric light source accommodated in the envelope is connected to the metal base by current supply conductors. The arc tube contains an electrode disposed at each end, mercury, a halide of sodium and a halide of one or more metals such as scandium, cesium, calcium, cadmium, barium, mercury, gallium, indium, thallium, germanium, tin, thorium, selenium, tellurium, etc. Generally the iodides of these metals are preferred, although the bromides and, in some cases chlorides may also be used. The arc tube also contains an inert gas such as argon. In the past it was fairly standard practice to support the arc tube within the vitreous outer envelope by attaching same to a metal harness. In this type of construction, the arc tube is supported within a harness by metal straps around the pinched ends of the arc tube with metal rods present along the sides of the arc tube so that a substantial amount of the metal harness structure is proximate to the arc tube. This type of harness support is disclosed, for example, in U.S. Pat. Nos. 3,452,238 and 3,569,766.

Some lamp manufacturers still employ such a harness frame type of mounting. However, J.F. Waymouth in *Electric Discharoe Lamps*, pp. 266–277, (MIT Press 1971) showed that photoelectrons ejected from the support rods of such frames, which carry lamp current, are responsible for the electrolysis of sodium from the arc tubes. This results in a depletion of the sodium level in the arc tubes and a concomitant increase in the required operating voltage of the lamp, along with a decrease in lumen output as the lamp ages and the sodium migrates from within the interior of the arc tube. His solution to this problem was to do away with the harness construction then used and replace it with a frame structure supporting the arc tube in which there are no structural support members present along the sides of the arc tube, and which utilizes a thin wire located away from the arc tube to carry the lamp current to one of the arc tube electrodes. However, he also found that this type of arc tube support structure provided little or no advantage if there was a vacuum in the outer jacket. Consequently, his solution employed a gas fill in the outer lamp jacket in combination with an arc tube support structure which is not proximate the sides of the arc tube. This type of lamp construction, is in wide use today and is shown, for example, in U.S. Pat. Nos. 3,937,996 and 4,581,557.

SUMMARY OF THE INVENTION

The present invention relates to the discovery that metal halide lamps have better lumen maintenance with concomitant lower voltage rise over the life of the lamp (i) if the surface of the metal frame parts is oxidized, (ii) if the outer jacket contains oxygen or an oxidizing agent in an amount sufficient to oxidize the surface of the metal frame parts during operation of the lamp or (iii) a combination of both oxidized frame parts and oxygen or an oxidizing agent present in the outer jacket space.

As employed herein, the term "frame parts" is meant to include all of the parts employed in positioning and/or supporting a metal halide arc tube within an outer vitreous envelope of a metal halide lamp, irrespective as to whether or not they function as current supply conductors, as well as any current supply conductors within said outer vitreous outer envelope.

The metal frame parts having an oxidized surface may be oxidized in the lamp in-situ; they may be oxidized prior to assembly of the lamp, or they may be oxidized employing a combination of both methods. Thus, in one embodiment, the present invention relates to a metal halide lamp having metal frame parts at least a portion of which have an oxidized surface. In another embodiment the present invention relates to a metal halide lamp containing means for oxidizing the surface of the metal frame parts in-situ during operation of the lamp. Thus in this embodiment the invention relates to a metal halide lamp comprising an arc discharge tube supported within a vitreous envelope by metal frame parts, wherein means for oxidizing the surface of said metal frame parts during operation of the lamp is also contained within said vitreous envelope. In one embodiment of the invention, the vitreous envelope will also contain an inert gas such as nitrogen, argon, helium, xenon or mixture thereof.

In a practical sense, most of the metal frame parts presently used in metal halide lamps are made of a nickel plated iron alloy. Such nickel plated parts are relatively inexpensive to fabricate, are pleasing in appearance and resist corrosion. The nickel plate has a bright, shiny, clear appearance. In marked contrast, nickel plated frame parts which have been oxidized in accordance with the invention, whether oxidized in the lamp in-situ, oxidized prior to assembly of the lamp, or oxidized by a combination of such methods, are distinctive in appearance from metal frame parts having a nickel surface which has not been oxidized, by virtue of their dull or matte, light gray appearance in contrast to the relatively shiny or glossy appearance of unoxidized nickel plate.

DETAILED DESCRIPTION

Figure 1:
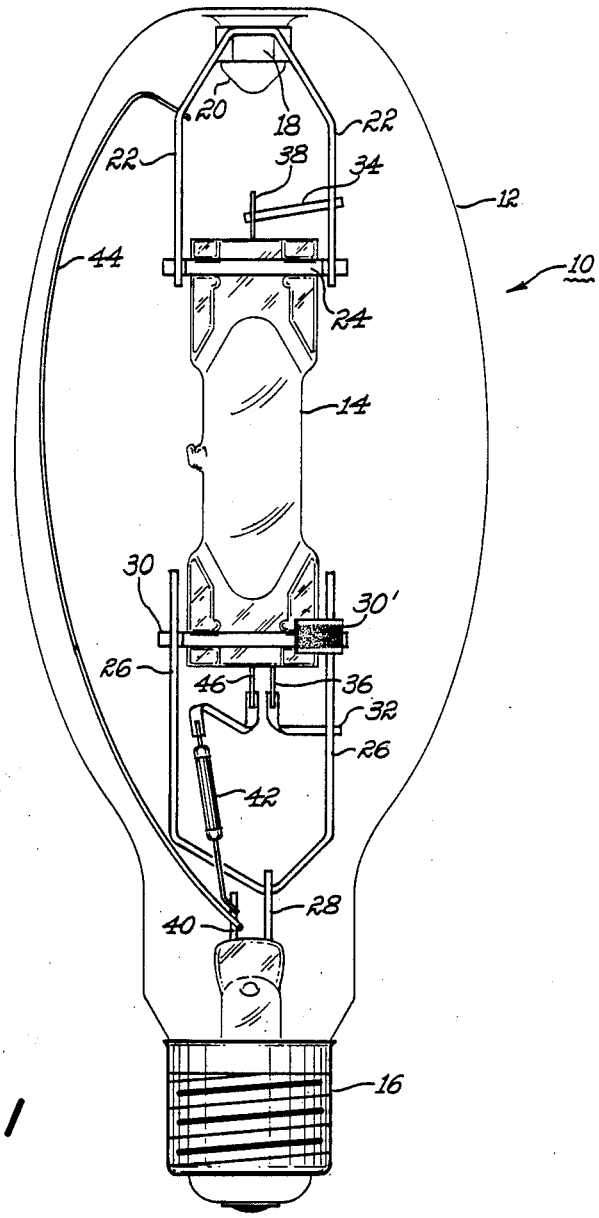
FIG. 1 is a schematic illustration of an embodiment of a single-ended metal halide lamp having a metal screw base useful in the practice of the present invention.

As set forth above, the present invention relates to metal halide electric lamps which comprise an outer envelope of vitreous, light transmissive material such as glass having an electric light source accommodated within said envelope which is connected to an appropriate current supply source by means of current supply conductors, wherein said light source comprises a sodium-containing metal halide arc discharge tube positioned and supported within said envelope by metal frame parts having an oxidized surface. In one embodiment the metal frame parts will be oxidized prior to assembly of the lamp components into the outer vitreous envelope. In another embodiment the outer envelope will contain oxygen or an oxidizing agent for oxidizing the surface of the metal frame parts in-situ during operation of the lamp. In yet another embodiment some of the frame parts will be oxidized or partially oxidized prior to assembly of the lamp with the rest of the frame parts being oxidized in-situ during operation of the lamp.

In addition to sodium, the arc tube will also contain a fill comprising mercury, a halide of one or more metals such as scandium, cesium, calcium, cadmium, barium, mercury, gallium, indium, thallium, dysprosium, germanium, tin, thorium, selenium, tellurium, etc., and, preferably, an inert starting gas such as argon. Generally the iodides of these metals are preferred, although the bromides and, in some cases, chlorides may also be used. The arc tube may contain sodium in the form of an amalgam with mercury, as one or more sodium halides, or mixture thereof. Generally it is desired that all of the sodium in the arc tube to be in the form of a sodium halide, such as sodium iodide, in order to minimize migration of the sodium into the wall of the arc tube.

The metal frame parts will generally comprise a nickel plated iron alloy. The surface of the metal frame parts may be oxidized prior to assembly of the lamp components into the lamp by any suitable means. One method of accomplishing such oxidation is to heat the parts in a suitable oxidizing atmosphere at an elevated temperature and for a time sufficient to oxidize the nickel surface which changes in appearance from a bright, shiny and glossy metal appearing surface to a dull, matte and gray color appearance. Air has been found to be a suitable oxidizing atmosphere and the surface of nickel plated iron alloy frame parts have been oxidized in accordance with the invention merely by heating in air at a temperature of 500°C. for a period of 60 minutes.

In another embodiment, the surface of the metal frame parts will be oxidized in-situ in an assembled, operating lamp which contains a suitable oxidizing agent within the outer lamp envelope. When the lamp is turned on the heat generated by the arc tube provides the elevated temperature required to oxidize the metal surface of the metal frame parts. A suitable oxidizing agent is an material that releases oxygen in an amount sufficient to oxidize the metal surfaces in the presence of the heat generated by the arc tube. In the practice of the present invention, it has been found that introducing oxygen into the outer jacket provides a facile way of oxidizing the metal (i.e., nickel and molybdenum) surfaces in-situ. The amount of oxygen used may vary from about $2 \times 10^{-6}$ moles per liter of outer envelope volume to about $2 \times 10^{-3}$ moles per liter of outer envelope volume. By outer envelope volume is meant the volume of space existing inside the outer envelope without accounting for the space that is occupied by the arc tube and frame parts.

In the case of a lamp in which a vacuum exists inside the outer vitreous envelope, substantially pure oxygen can be introduced into the inner envelope space between the arc tube and the interior surface of the outer envelope, in an amount set forth above, during the final stages of the lamp assembly and just prior to sealing the outer envelope. In another embodiment where an inert gas such as nitrogen or argon is present in the space between the arc tube and the interior surface of the outer vitreous envelope, it has been found convenient to dose the inert gas with the proper amount of oxygen and then to introduce the oxygen-containing gas into the interior of the outer lamp envelope.

Referring now to FIG. 1, which is a schematic view of an illustrative, but non-limiting embodiment of a metal halide lamp useful in the practice of the present invention, lamp 10 includes an outer envelope 12, made of a light transmissive vitreous material, such as glass, a light transmissive arc tube 14 made of a high temperature, light transmissive, vitreous material such as quartz and a base 16 having suitable electrical contacts for making electrical connection to the arc tube. Arc tube 14 is held in place within envelope 12 by frame parts comprising, at one end of the arc tube, a spring clip metal band 18 surrounding a dimple 20 in the envelope to which is attached by spot welding support member 22 which is also spot welded to strap member 24 which is securely mechanically fastened about the pinch seal region of arc tube 14. The other end of the arc tube is secured by support member 26 which is spot welded at one end to electrically conductive terminal 28 and welded at the other end to strap member 30 which is securely mechanically fastened about the other pinch seal region of the arc tube. Conductive members 32 and 34 are spot welded at one end to support members 26 and 22, respectively, and at the other end to inleads 36 and 38, respectively, of the respective arc tube electrodes (not shown). Electrically conductive member 40 is spot welded to starting resistor 42 and current conductor 44. The other end of resistor 42 is connected to the inlead 46 of a starting electorde (not shown). Except for conductor 44 and inleads 36, 38 and 46 which are made of molybdenum and the actual resistor portion of resistor 42, all of the frame parts herein mentioned are made of a nickel plated steel. The surface of all of these metal frame parts is oxidized either in-situ during the initial period of lamp operation or oxidized prior to assembly of the lamp components into a completed lamp. The lamp also contains a getter strip 30' coated with a metal alloy material primarily to getter or absorb hydrogen from inside the lamp envelope.

Figure 2:
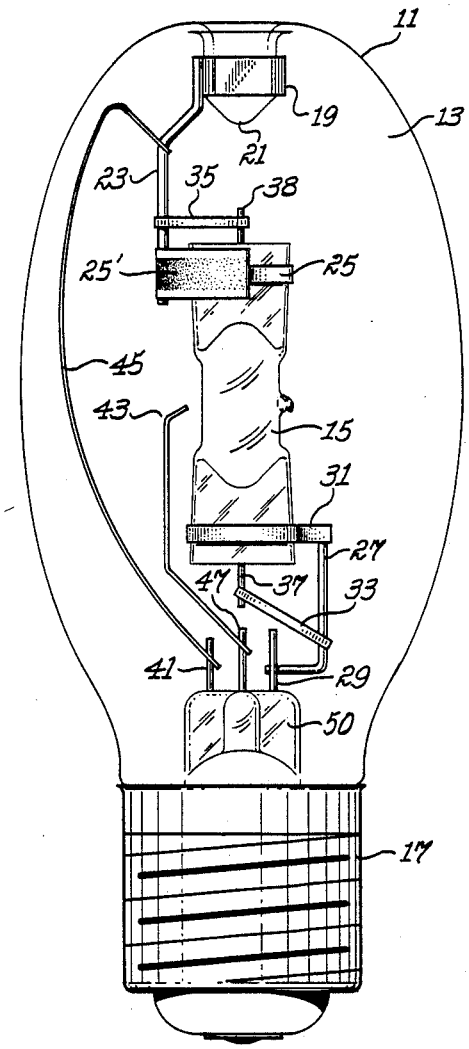
FIG. 2 is a schematic illustration of another embodiment of a metal halide lamp useful in the present invention.

FIG. 2 is a schematic illustration of another type of metal halide lamp construction useful in the practice of the present invention. Referring to FIG. 2, lamp 11 contains an outer, light transmissive, vitreous envelope 13 containing within a light transmissive arc tube 15 made of, i.e., quartz. Metal base 17 is attached to one end of envelope 11 for making an electrical connection to the arc tube. Arc tube 15 is secured in envelope 13 by nickel plated steel frame parts. One end of arc tube 15 is secured by frame parts comprising a spring clip metal band 19 surrounding dimple 21 molded in envelope 13 to which is attached support member 23 which, in turn, is attached to strap member 25 which is securely mechanically fastened about the pinch seal region of arc tube 15. The other end of the arc tube is secured by a combination of strap member 31 which is securely mechanically fastened about the other pinch seal region of the arc tube and which is attached to support member 27. Conductive members 33 and 35 are attached to support members 27 and 23, respectively, and to inleads 37 and 38 of the two arc tube electrodes (not shown). Support member 27 is secured by attachment to conductive member 29 which passes through seal 50 of envelope 13. Conductive member 47, which also passes through seal 50, is attached to starter wire 43 made of tungsten, and conductive member 41 is attached to conductive fly lead 45 made of molybdenum which, in turn, is attached at its other end to support 23 for supplying current to one of the arc tube electrodes. The lamp also contains a getter strip 25, coated with a metal alloy material to absorb hydrogen from inside the lamp envelope. Except for inleads 37 and 38, starter wire 43 and fly lead 45, all of the frame parts mentioned are made of nickel plated steel. The surface of these metal parts will be oxidized either prior to assembly of the lamp components into a finished lamp or they will be oxidized in the lamp in-situ during the first few hundred hours of lamp operation.

The invention will be further understood by reference to the following examples.

EXAMPLES

Example 1

In this experiment a number of commercially available metal halide lamps of the type illustrated in FIG. 2 were used. The outer, oval shaped envelope was 191 mm long 75 mm in diameter at its widest point and contained an arc tube 29 mm long and 14 mm in diameter which was made of quartz and filled with mercury, sodium iodide, scandium iodide, thorium iodide and argon as a starting gas. The outer envelope was filled with nitrogen at a pressure of 380 torr. The volume inside the outer glass envelope was about 325 $cm^3$. The metal parts had a total surface area of about 15$cm^2$. Fourteen lamps contained metal frame parts whose surface was oxidized prior to assembly of the lamp components into the completed lamp by heating in air at a temperature of about 500°C. for one hour, which caused the bright, clean, shiny nickel plated surface to become dull, matte, gray color. These lamps are designed for operation at 175 watts at a nominal voltage of about 135 volts. Forty lamps were made from parts that had not been oxidized. After 3,000 hours lamp operation, the light output in lumens for the lamps having the surface oxidized metal parts averaged 94.3% of that after 100 hours, whereas the lumen maintenance of the lamps having the unoxidized metal surfaces was only 85.6% of that There was no significant difference in voltage rise between the two groups of lamps.

Example 2

In this series of experiments a number of commercially available metal halide lamps of the type illustrated in FIG. 1 were used. The metal frame parts were not oxidized prior to lamp assembly. The glass outer envelope of these lamps had an overall length of 279 mm and a diameter at the widest part of 117 mm and contained an arc tube 58 mm long and 15 mm in diameter made of quartz and filled with sodium iodide, scandium iodide, thorium iodide, mercury and argon. The volume in the glass envelope was about 1275 $cm^3$. These lamps are designed for operation at 400 watts at a nominal voltage of about 135 volts.

In one group of eight lamps the outer envelope of 100 torr. In another contained nitrogen at a pressure group of eight lamps the nitrogen fill in the outer envelope contained 1% oxygen and the total pressure was 100 torr. After a total of 2,000 hours of lamp operation the average lumen output of the lamps having oxygen in the nitrogen fill was 79% of the 100 hour output, compared to only 76% for those lamps that didn't have oxygen in the nitrogen fill. There was no significant difference between the two groups in either voltage rise or color shift.

Example 3

In this series of experiments a number of the same commercially available metal halide lamps employed in Example 1 were used, except that the frame parts were not oxidized prior to lamp assembly. The outer envelope of the lamps contained nitrogen at a pressure of 380 torr. In eight lamps the nitrogen contained 1% oxygen (total pressure 380 torr) and in seven lamps the nitrogen did not contain nitrogen. After 2,000 hours of operation or burning, the lamps that had the oxygen in the nitrogen fill had a lumen output of 88% of the lumen output measured after the first 100 hours and a voltage rise of only 0.1 volt compared to a 2.8 volt rise and only 82% lumen maintenance for the lamps that did not contain oxygen in the outer envelope. Further, the CCX color shift of the oxygen containing lamps was only −0.074 points compared to −17.4 points for the lamps that contained only nitrogen in the outer envelope.

What is claimed is:

1. A metal halide arc discharge lamp comprising an arc tube supported within an outer vitreous envelope by metal frame parts having a nickel surface wherein the arc tube contains a fill comprising mercury, a sodium halide and an inert starting gas and wherein an oxidizing agent is present within the inside of said outer envelope in an amount sufficient to release oxygen in an amount equivalent to about $2 \times 10^{-6}$ to $2 \times 10^{-3}$ moles per liter of outer envelope volume to oxidize the surface of said metal frame parts during operation of the lamp.

2. A metal halide arc discharge lamp comprising an arc tube supported within a vitreous envelope by metal frame parts which comprise a nickel plated iron alloy, wherein the arc tube contains a fill comprising mercury, a sodium halide and an inert starting gas, wherein oxygen is present in said outer envelope in an amount of from about $2 \times 10^{-6}$ to $2 \times 10^{-3}$ moles per liter of volume enclosed within said vitreous envelope and wherein an inert gas is also present within the inside of said vitreous envelope.

* * * * *